United States Patent [19]

Reinhardt

[11] Patent Number: 4,747,268

[45] Date of Patent: May 31, 1988

[54] CONTROL MEANS FOR A PLURALITY OF MECHANICALLY COUPLED HYDROSTATIC MACHINES WITH VARIABLE VOLUME IN A DRIVE SYSTEM WITH IMPRESSED PRESSURE

[75] Inventor: Peter Reinhardt, Lohr, Fed. Rep. of Germany

[73] Assignee: Mannesmann Rexroth GmbH, Fed. Rep. of Germany

[21] Appl. No.: 922,197

[22] Filed: Oct. 23, 1986

[30] Foreign Application Priority Data

Nov. 28, 1985 [DE] Fed. Rep. of Germany ..... 3541998

[51] Int. Cl.[4] ..... F16D 31/02

[52] U.S. Cl. ..... 60/426; 60/484; 60/711

[58] Field of Search ..... 60/426, 484, 483, 709, 60/711

[56] References Cited

U.S. PATENT DOCUMENTS

| | | | |
|---|---|---|---|
| 2,419,810 | 4/1947 | Beall | 60/709 X |
| 3,511,052 | 5/1970 | Gillespie | 60/711 |
| 4,258,552 | 3/1981 | Ryker et al. | 60/711 |

*Primary Examiner*—William E. Wayner

*Attorney, Agent, or Firm*—Harness, Dickey & Pierce

[57] ABSTRACT

A plurality of mechanically coupled secondarily controlled hydrostatic machines with variable volume are connected to a line with impressed system pressure fed by a primary unit. By reducing the variable volume to 0 in individual hydrostatic machines the remaining machines are subjected to a higher torque which results in a greater pivot angle of the remaining secondary units. As a result the efficiency and controllability are improved. The changeover is effected in dependence upon an upper and lower switching point corresponding to the pivot angle of the unit remaining in engagement.

8 Claims, 1 Drawing Sheet

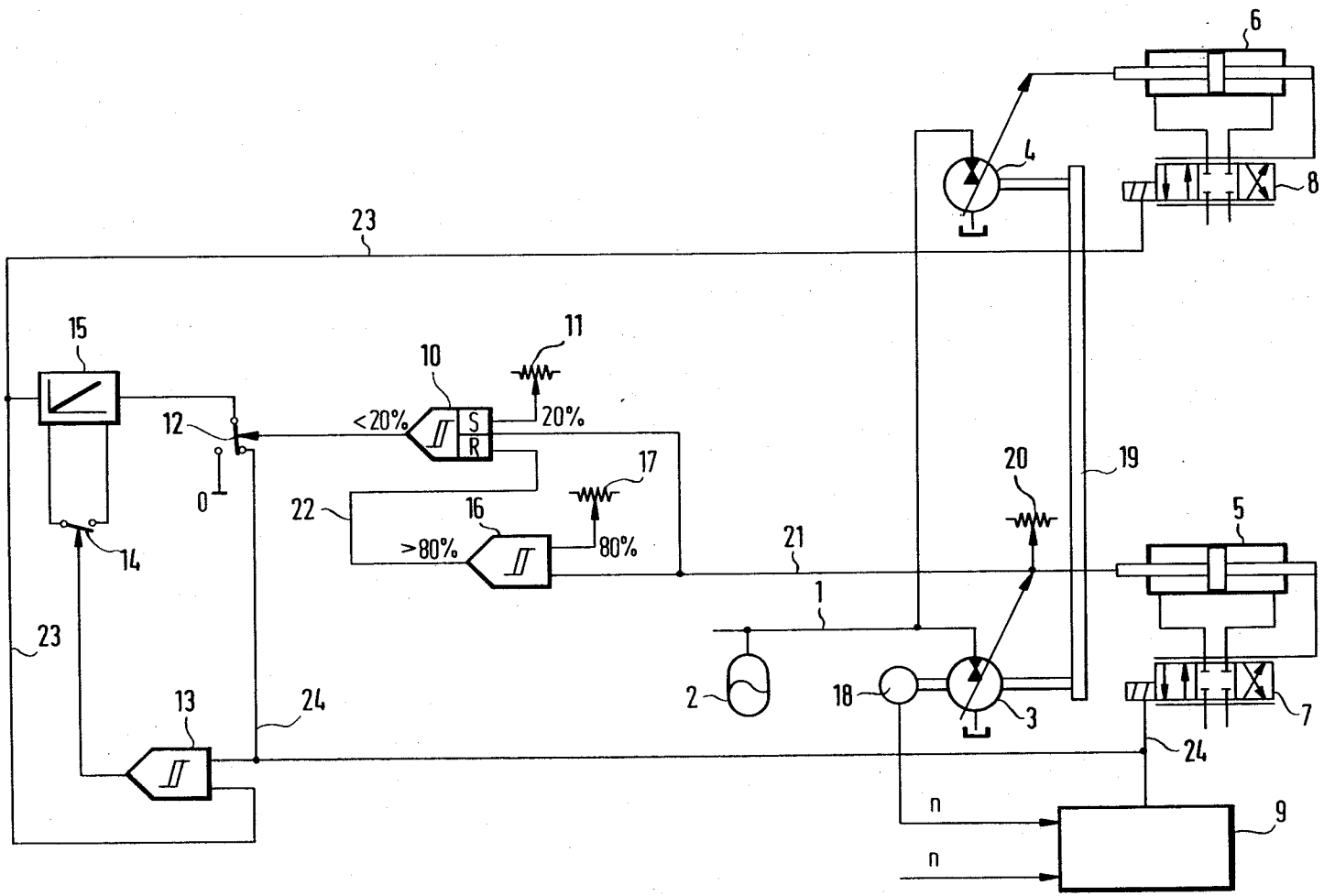
6
8
5
7
9
24
19
4
20
3
n
n
18
1
21
2
17
80%
11
20%
16
10
S
R
>80%
<20%
23
22
24
12
0
13
14
15
23

CONTROL MEANS FOR A PLURALITY OF MECHANICALLY COUPLED HYDROSTATIC MACHINES WITH VARIABLE VOLUME IN A DRIVE SYSTEM WITH IMPRESSED PRESSURE

BACKGROUND OF THE INVENTION

The invention relates to a control means for a plurality of mechanically coupled hydrostatic machines with variable volume in a drive system with impressed pressure.

When using secondary units for driving mechanical machines frequently several units are mechanically coupled. The advantage is that the smaller working machines are easier to install in the system or the forces, as in wheel vehicles, are easier to transmit.

The motors are always mechanically coupled. This can be done in form-locking or force-locking manner.

Frequently, the load of the secondary units varies over a large range.

Under relatively small load and thus with small pivot angle of the secondary units the controllability deteriorates and uneven running occurs. The efficiency also deteriorates.

It is not expedient to reduce the operating pressure because this is only possible in the ratio of about 1:2 to 1:3. Moreover, other consumers are then influenced.

SUMMARY OF THE INVENTION

The invention is based on the problem of improving the controllability and efficiency and this problem is solved according to the invention by the features set forth in the characterizing clause of the claim.

Thus, according to the invention only as many machines as are in fact required are activated.

Further advantageous developments of the invention are set forth in the subsidiary claims.

BRIEF DESCRIPTION OF THE DRAWING

An example of embodiment of the invention will be explained below with the aid of the drawings which show schematically a control means for a drive system having two mechanically coupled drives with impressed pressure.

DETAILED DESCRIPTION OF THE PREFERRED EMBODIMENT OF THE INVENTION

Via a primary unit which is not illustrated impressed pressure is introduced into the power system 1 to which a hydraulic reservoir 2 and the secondary units 3 and 4 are connected.

The secondary units 3 and 4 are hydrostatic machines, in particular reciprocating piston or axial piston machines with variable delivery volume or displacement. The adjustment of the volume of the secondary units 3 and 4 is by servo or adjusting cylinders 5 and 6 whose cylinder chambers are connectable via drive means 7 and 8 to a fluid source or to a tank.

The drive means 7 and 8 are activated by the output signal of a speed regulator 9 to which the actual value of the speed is supplied by a tachometer machine 18 coupled to the unit 3 along with the correspondingly adjustable desired value for the speed.

As indicated at 19 the two secondary units 3 and 4 are mechanically coupled together in some way.

The pivot angle of the secondary units 3 and 4 adjust itself according to the speed regulator 9 and the load.

The adjusting means of the secondary unit 3 actuates a potentiometer 20 whose tap voltage on the line 21 is applied to a first switching amplifier 16 in which the measured value for the pivot angle of the secondary unit 3 is compared with an upper switching point which is set at a potentiometer 17 for example to 80% of the maximum volume of the secondary unit 3. Furthermore, the tap voltage of the potentiometer 20 is applied to a second switching amplifier P in which the comparison is made with the lower switching point which for example is 20% of the maximum volume of the secondary unit 3 and can be set at a potentiometer 11.

The output of the switching amplifier 16 is connected via a line 22 to the reset input R of the second switching amplifier 10. The output signal of the second switching amplifier 10 actuates a switchover means 12 which is disposed in a line 24/23 leading from the speed regulator 9 to the drive means 8 of the secondary unit 4 whilst the drive means 7 of the secondary unit 3 is connected via the line 24 directly to the speed regulator 9.

Also disposed in the line 24/23 between the switchover means 12 and the drive means 8 is a ramp former 15 which is short-circuited by a switch 14 when the switch 14 is closed and which is activated when the switch 14 is open. The switch 14 is driven by a switching amplifier 13 whose one input is connected to the line 24 and thus to the output of the speed regulator 9 and whose other input is connected via a line 23 to the output of the ramp former 15.

The mode of operation is as follows: If the pivot angle of the secondary unit 3 drops below 20% of the maximum value this is detected by the switching amplifier 10, the switching threshold of which is set at the potentiometer 11. The switching amplifier 10 switches over the switchover means 12 and thereby interrupts the connection between the speed regulator 9 and the drive means 8. By the switchover means the line 23 and thus the drive means 8 is now switched via the closed switch 14 to a desired value 0.

There is thus applied to the switching amplifier 13 a difference between the output signal of the speed regulator 9 on the line 24 and the desired value for the volume of the secondary unit 4 lying via the still short-circuited ramp former 15 on the line 23. The switching amplifier therefore switches over and energizes the switch 14 which is opened. As a result the short circuiting of the ramp former 15 is cancelled and the desired value is reduced in ramp-like manner. Thus, on reaching the lower switching point of for example 20% of the maximum pivot angle of the secondary units 3 and 4 the pivot angle of the secondary unit 4 is reduced via a ramp to the zero value.

The torque which was furnished by the unit 4 is taken over by the unit 3 and the pivot angle thereof therefore increases to 40%. The reduction of the torque of the unit 4 takes place gradually to avoid shocks in the entire system.

If due to the load the pivot angle of the unit 3 increases and reaches the upper switching point of for example 80%, the switching amplifier 16 responds, the switching point of which is set at the potentiometer 17, and via the line 22 resets the switching amplifier 10. As a result the switchover means 12 is switched back and the output signal of the speed regulator 9 consequently reaches the ramp former 15.

As soon as the output of the ramp former 15 corresponds to the signal on the line 24 the switch 14 is closed by the switching amplifier 13 and thus the ramp former put out of operation and the full adjusting value of the speed regulator 9 is passed on to the drive means 8. As a result the secondary unit 4 is pivoted back to 0 on reaching the lower switching point is reactivated via the ramp function of the ramp former 15. The pivot angle of the unit 3 thus drops to 40%.

Thus, the pivot angle or the adjusting value for the pivot angle is measured and compared with the switching points in the switching amplifiers 10 and 16. The measurement can be made by means of the potentiometer 20 or also by means of a limit switch. On the other hand, the switching points may also be predetermined by the desired value for the pivot angle of the secondary units.

I claim:

1. Control means for a system comprised of at least first and second mechanically coupled hydrostatic machines having variable outputs, means for varying the output of each of said hydrostatic machines, a source of constant input pressure applied to each of said hydrostatic machines, the improvement comprising means for reducing the output of one of said hydrostatic machines to zero when the output of the other of said hydrostatic machines is adjusted to a value below a predetermined lower switching point and for adjusting the output of said one hydrostatic machine above zero when the output of said other hydrostatic machine is above an upper predetermined switching point for operating said other said hydrostatic machine in a more efficient manner, adjustment of said one hydrostatic machine from the volume corresponding to the lower switching point to the zero volume and from the zero volume to the volume corresponding to the upper switching point being effected via a ramp function.

2. Control means according to claim 1, characterized in that the means for varying the output of each of the hydrostatic means comprises a pivotally supported member, the pivot angle for the adjustment of the machines is measured and compared with the switching points.

3. Control means according to claim 1 characterized in that the adjustment value for the adjustment of the machines is compared with the switching points.

4. Control means for a system comprised of at least first and second mechanically coupled hydrostatic machines having variable outputs, means for varying the output of each of said hydrostatic machines, a source of constant input pressure applied to each of said hydrostatic machines, the improvement comprising means for reducing the output of one of said hydrostatic machines to zero when the output of the other of said hydrostatic machines is adjusted to a value below a predetermined lower switching point and for adjusting the output of said one hydrostatic machine above zero when the output of said other hydrostatic machine is above an upper predetermined switching point for operating said other said hydrostatic machine in a more efficient manner, and a speed regulator for said other hydrostatic machine and whose output signal is applied to said adjusting means of said other hydrostatic machine directly and to said adjusting means of said one hydrostatic machine via a switchover means.

5. Control means according to claim 4, characterized in that to the switchover means is connected to a ramp former.

6. Control means according to claim 5, characterized in that the ramp former is activatable via a switch driven by a switching amplifier whose inputs are connected to the input and the output of the switchover means.

7. Control means according to claim 4, characterized in that the measured value of the other hydrostatic machine is compared with the upper switching value by a first switching amplifier, said first switching amplifier driving a second switching amplifier for comparing the value with the lower switching point, said second switching amplifier activating the switchover means.

8. Control means for a system comprised of at least first and second mechanically coupled hydrostatic machines having variable outputs, means for varying the output of each of said hydrostatic machines, a source of constant input pressure applied to each of said hydrostatic machines, the improvement comprising means for reducing the output of one of said hydrostatic machines to zero when the output of the other of said hydrostatic machines is adjusted to a value below a predetermined lower switching point and for adjusting the output of said one hydrostatic machine above zero when the output of said other hydrostatic machine is above an upper predetermined switching point at which time the output of both of said hydrostatic machines is adjusted for operating said other said hydrostatic machine in a more efficient manner.

* * * * *